US005794583A

United States Patent [19]

Ichieda

[11] Patent Number: 5,794,583

[45] Date of Patent: Aug. 18, 1998

[54] SIDE PRESSURE TYPE ROTARY ENGINE

[75] Inventor: Masao Ichieda, Nara-ken, Japan

[73] Assignee: Masahiro Ichieda, Amagasaki, Japan

[21] Appl. No.: 659,570

[22] Filed: Jun. 6, 1996

[30] Foreign Application Priority Data

Jun. 6, 1995 [JP] Japan ..... 7-164741

[51] Int. Cl.[6] ..... F02B 53/00

[52] U.S. Cl. ..... 123/244; 418/231

[58] Field of Search ..... 123/213, 215, 123/244; 418/231

[56] References Cited

U.S. PATENT DOCUMENTS 3,908,608 9/1975 Fox ..... 123/215

FOREIGN PATENT DOCUMENTS 2242967 3/1974 Germany ..... 123/244
57-5503 1/1982 Japan .

*Primary Examiner*—Michael Koczo

*Attorney, Agent, or Firm*—Browdy and Neimark

[57] ABSTRACT

A side pressure type rotary engine of a simple construction is formed by a cylinder having a suction port and an exhaust port in predetermined portions thereof, a main shaft passed through the cylinder, a rotor provided at both sides of flat surface portions thereof with a pair of working chamber-forming recesses and adapted to be rotated unitarily with the main shaft, a fixed blocking element, an active block, a suction and exhaust blocking element and an expansion blocking element which are movable in the axial direction of the main shaft, and a cylindrical cam and rocker arms which constitute a driving mechanism for moving the active block, suction and exhaust blocking element and expansion blocking element. The rotor is rotated to move the active block, suction and exhaust blocking element and expansion blocking element at predetermined timings and strokes, whereby suction, compression, expansion and exhaust strokes are carried out. Thus, an expansive force interrupted by the expansion blocking element is exerted on the rotor in the tangential direction thereof so that the expansive force of a gas is converted efficiently into a rotational force.

6 Claims, 8 Drawing Sheets

SIDE PRESSURE TYPE ROTARY ENGINE

BACKGROUND OF THE INVENTION

1. Field of the Invention

This invention relates to a side pressure type rotary engine capable of efficiently converting an expansive force of a gas into a rotational force.

2. Description of the Prior Art

The engines generally used and adapted to convert an expansive force of a gas into a rotational force and take out the rotational force as a driving force include a crank engine adapted to transmit the motions of a piston, which is moved by the power of the expansive force, to a crank via a connecting rod. The rotary engines which have heretofore been known include Wankel type and vane type rotary engines.

However, in a crank engine presently used, the expansive force of a gas works on a crankshaft through a connecting rod and a crank arm at right angles thereto near the top dead center thereof where the expansion force is the strongest, and is converted into a rotational force by a crank. Therefore, the conversion efficiency is low, and the fuel efficiency is low. Although some types of rotary engines are known, all of them have a low efficiency and an excessively complicated structure.

The present invention aims at solving these problems and provides a rotary engine having a simple structure and a high efficiency.

OBJECTS AND SUMMARY OF THE INVENTION

The present invention has attained a side pressure type rotary engine adapted to exert an expansive force of a gas to a rotor, which is mounted fixedly on a main shaft in the tangential direction of the circle the center of which is on the axis of the main shaft, and capable of efficiently converting the expansive force into a rotational force. This engine is provided with a cylinder having a suction port and an exhaust port formed in predetermined portions thereof which are circumferentially spaced from each other, a main shaft passed through the cylinder along the axis thereof, a rotor having a columnar body the outer circumferential surface of which extends along the inner circumferential surface of the cylinder, provided with a pair of working chamber-forming recesses on both sides of a pair of flat end surface portions opposed to each other diametrically on both sides of the axis of the rotor, and mounted fixedly on the main shaft and rotated unitarily therewith, a fixed blocking element adapted to close a predetermined range of a head portion of the cylinder with a bottom surface thereof which the flat end surface portions of the rotor slidingly contact, an active block movable along side surfaces of the fixed blocking element on the head portion of the cylinder and in parallel with the axis of the cylinder, a first movable blocking element, which is between the suction port and the exhaust port, adapted to close the part of the head portion of the cylinder and move in parallel with the axis of the cylinder so as to divide one of the working chamber-forming recesses in the end surface of the rotor into two working chamber-forming spaces, a second movable blocking element, which is substantially opposed to the first movable blocking element with respect to the axis of the cylinder, adapted to close the part of the head portion of the cylinder and move in parallel with the axis of the cylinder so as to divide the other working chamber-forming recess, which is not divided by the first movable blocking element, in the end surface of the rotor into two working chamber-forming spaces, and a driving mechanism adapted to move the active block and first and second movable blocking elements at predetermined timings and strokes, the expansive force of a gas being exerted on the rotor in the tangential direction of the circle the center of which is on the axis of the main shaft to rotate the main shaft.

The driving mechanism mentioned above can be formed by, for example, a cylindrical cam provided on a free end portion of the main shaft, and rocker arms engaged with a plurality of cam grooves in this cylindrical cam.

It is also possible to improve the efficiency by efficiently utilizing energy by rotating a turbine with exhaust pressure and thereby driving a suction blower.

If a plurality of cylinders are provided on the same circle having an exhaust turbine-carrying propeller shaft in the center, the rocker arms can be driven by a single cylindrical cam, and a loss of exhaust pressure supplied to the exhaust turbine can be reduced by setting the distance between the exhaust port of each cylinder and a pressure supply port of the exhaust turbine to be equal and shorter.

For example, a propeller shaft having both a suction blower and an exhaust turbine is provided, and a plurality of cylinders on the same circle having this propeller shaft in the center, the suction port and exhaust port of each cylinder being set in contact with a discharge port of the suction blower and a pressure supply port of the exhaust turbine. A driving mechanism for this case can be formed by a cylindrical cam provided on a free end portion of the propeller shaft and a plurality of rocker arms engaged with cam grooves in this cylindrical cam.

In the side pressure type engine according to the present invention, the rotor is rotated along the inner circumferential surface of a cylinder, and the active block and first and second movable blocking elements are moved in parallel with the axis of the cylinder at predetermined timings and strokes, whereby the spaces defined by the outer circumferential surface of the main shaft, the inner circumferential surface of the cylinder, the working chamber-forming recesses in the end surface of the rotor and the fixed blocking element or the active block form a pair of variable displacement working chambers, in which the suction, compression, expansion and exhaustion of a gas are carried out. During this time, a working chamber-forming space in which the suction of a gas is to be carried out is separated from a working chamber in which an exhaust stroke is carried out, by the first movable blocking element, and a working chamber-forming space in which the ignition and expansion of a gas are to be carried out is separated from a working chamber in which a compression stroke is carried out, by the second movable blocking element. In the expansion side working chamber-forming space, the expansion of the expanded gas toward the second movable blocking element is interrupted, and a wall surface of the working chamber-forming recess on the side opposed to the second movable blocking element is pressed by the expansive force in the tangential direction of the rotor, whereby the expansive force of the gas is converted into a rotational force. In the side pressure type engine according to the present invention, the expansion of the expanded gas toward the side of the second movable blocking element is thus interrupted and presses the wall surface of the working chamber-forming recess in the rotor, so that the expansive force of the gas can be exerted in the tangential direction of the rotor and converted into a rotational force efficiently.

If the active block is moved at a larger stroke than the first and second movable blocking elements with a top dead center of the active block set high, a suction volume and a compression ratio increase. Concretely speaking, for example, in an engine in which the active block is moved by a cylindrical cam, suitably setting a profile of the cam groove at a top dead center makes the above effect possible.

The suction volume can be increased by changing the shape of the wall surfaces of the working chambers, whereby a rotational force can be increased. Concretely speaking, for example, if the depth of the portions of the wall surfaces of the working chamber-forming recesses which are on the front side with respect to the direction of rotation of the main shaft is set larger at the parts thereof which are near the bottom surfaces of the working chamber-forming recesses than that of these bottom surfaces, the suction volume and rotational force increase.

If the shape of the bottom surfaces of the working chambers is changed so as to increase the pressure receiving area thereof at the time of expansion of a gas, the rotational force can be increased. Concretely speaking, for example, recessing the bottom surfaces of the working chamber-forming recesses so as to form V-shaped bottom surfaces makes this effect possible.

These techniques enable the achievement of improvement of engine efficiency, the lowering of fuel cost, simplification of construction of the engine, miniaturization and weight reduction of the engine and facilitation of the production of the engine.

The above and other objects, features and advantages of the present invention will become apparent from the following detailed description which is to be read in conjunction with the accompanying drawings.

BRIEF DESCRIPTION OF THE DRAWINGS

FIG. 2(*b*) is a side view of FIG. 2(*a*).

FIG. 3(*b*) is an elevation showing the structure of FIG. 1 in a second operating position.

FIG. 3(*c*) is an elevation showing the structure of FIG. 1 in a third operating position.

FIG. 4(*b*) is another explanatory view showing the operation of the rotor, viewed from a position above the rotor, of the basic structure shown in FIG. 1.

FIG. 4(*c*) is a third explanatory view showing the operation of the rotor, viewed form a position above the rotor, of the basic structure shown in FIG. 1.

FIG. 6(*b*) is a partially cutaway perspective view of another example of a side pressure type rotary engine.

FIG. 7(*b*) is a development elevation showing a second operational condition of an embodiment of the present invention.

FIG. 7(*c*) is a development elevation showing a third operational condition of an embodiment of the present invention.

DESCRIPTION OF THE PREFERRED EMBODIMENTS

Figure 1:
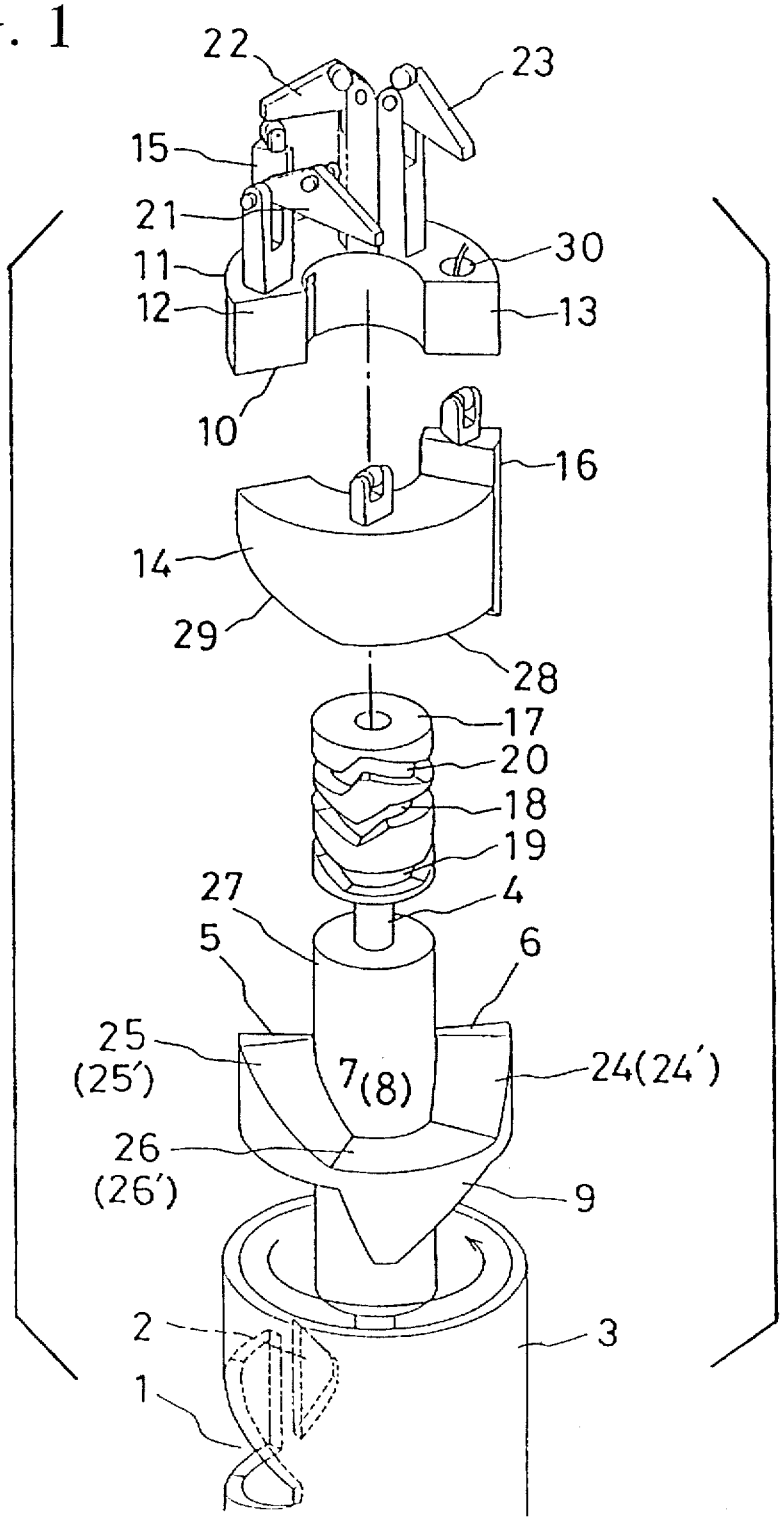
FIG. 1 is an exploded view showing the basic construction of the side pressure type rotary engine according to the present invention.
Figure 2A:
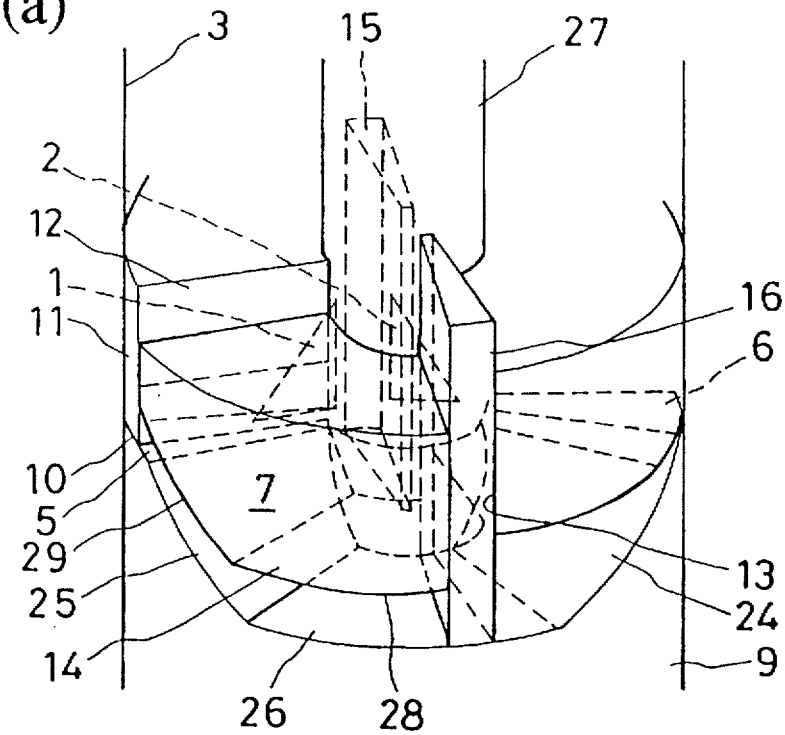
FIG. 2(*a*) is a construction diagram of principal portions of the basic structure shown in FIG. 1.
Figure 2B:
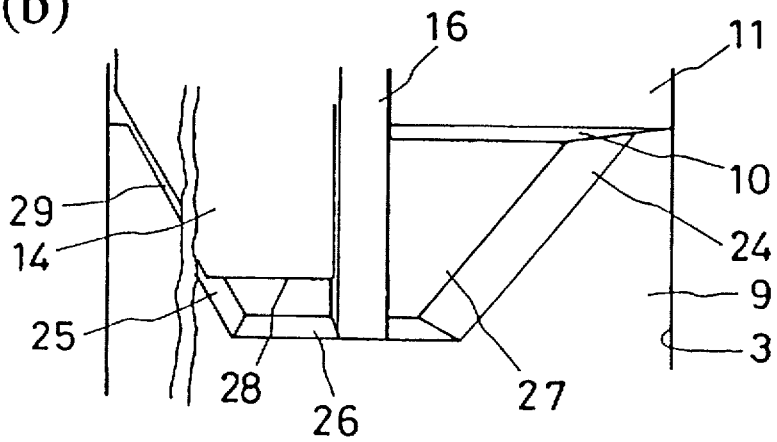

The side pressure type rotary engine shown in FIGS. 1 and 2 comprises a cylinder 3 having a suction port 1 and an exhaust port 2 formed in predetermined portions thereof which are circumferentially spaced from each other. A main shaft 4 is passed through the cylinder 3 along the axis thereof. A rotor 9 has a columnar body, the outer circumferential surface of which extends along the inner circumferential surface of the cylinder 3, provided with first and second or a pair of working chamber-forming recesses 7, 8 on both sides of a pair of flat end surface portions 5, 6 opposed to each other diametrically on both sides of the axis of the rotor 9, and mounted fixedly on the main shaft 4 and rotated unitarily therewith. A fixed blocking element 11 is adapted to close a predetermined range of a head portion of the cylinder 3 with a bottom surface 10 thereof which the flat end surface portions 5, 6 of the rotor 9 slidingly contact, an active block 14 movable along side surfaces 12, 13 of the fixed blocking element 11 and in parallel with the axis of the cylinder 3 so as to approach to or recede from the working chamber-forming recess, changing the volumes of the chamber-forming spaces formed in those recesses. A suction and exhaust blocking element (movable blocking element) 15, which is between the suction port 1 and exhaust port 2, is adapted to close the part of the head portion of the cylinder 3 and move in parallel with the axis of the cylinder so as to divide the working chamber-forming recesses 7, 8 in the end surface of the rotor 9 into two working chamber-forming spaces respectively. An expansion blocking element (movable blocking element) 16, which is substantially opposed to the suction and exhaust blocking element 15 with respect to the axis of the cylinder 3, is adapted to close the part of the head portion of the cylinder 3 and move in parallel with the axis of the cylinder 3 so as to divide the working chamber-forming recess 7 or 8, which is not the one divided by the suction and exhaust blocking element 15, into two working chamber-forming spaces. A driving mechanism is adapted to move the active block 14, suction and exhaust blocking element 15 and expansion blocking element 16 at predetermined in-timings and strokes, and formed by a cylindrical cam 17, provided on a free end portion of the main shaft 4. Rocker arms 21, 22, 23 are provided for driving the active block, suction and exhaust blocking element and expansion blocking element; which rocker arms are engageable with three cam grooves 18, 19, 20 in the cylindrical cam 17.

In the working chamber-forming recesses 7, 8 in the rotor 9, front and rear wall surfaces 24 (24'), 25 (25') with respect to the rotational direction of the rotor which constitute boundaries between these recesses and flat surface portion 5, 6 are formed as inclined surfaces cut by straight lines crossing the axis of the main shaft at right angles thereto, and a bottom surface 26 (26') thereof as a flat surface crossing the same axis at right angles thereto. The rotor 9 is mounted in a closely fixed state on a rotor base portion 27 formed on the main shaft 4.

The cylindrical cam 17 is fixed to a free end portion of the main shaft 4. The three cam grooves 18, 19, 20 are used to drive the active block, suction and exhaust blocking element and expansion blocking element respectively. As the mid point roller portions of the rocker arms 21, 22, 23 are engaged with these cam grooves, the active block 14, suction and exhaust blocking element 15 and expansion blocking element 16 with which the free end portions of the rocker arms 21, 22, 23 are engaged are moved in parallel with the axis of the main shaft 4 at predetermined timings and strokes. The base end portions of the rocker arms 21, 22, 23 are fixed to the fixed blocking element 11 (they may also be fixed to the cylinder 3 instead of the fixed blocking element 11).

The suction port 1 and exhaust port 2 are provided so that the former is on the front side in the rotational direction of the rotor 9, and the suction and exhaust blocking element 15 is provided so as to be positioned between these ports 1, 2. The fixed blocking element 11 cross-sectionally occupies, for example, substantially ¾ of a cross-sectional area of the cylinder, and extends so that a smaller part up to a position in front of the suction and exhaust blocking element 15 is positioned on the front side in the rotational direction of the main shaft with the remaining larger part on the rear side. The outer circumferential surface of this fixed blocking element 11 is closely fixed to the inner surface of the cylinder 3, and the inner circumferential surface thereof closely contacts the rotor base portion 27. The active block 14 is formed so that the cross-sectional area thereof the thereof occupies nearly ¼ of that of the cylinder, and has an inclined surface 29, the angle of inclination of which is equal to that of the rear wall surface 25 of the working chamber-forming recesses 7, 8, which inclined surface 29, extends from a rear portion of a bottom surface 28, which comprises a flat surface perpendicular to the axis of the main shaft, to a rear side surface. The outer circumferential surface of the active block 14 closely contacts the inner surface of the cylinder 3, and the inner circumferential surface thereof closely contacts the rotor base portion 27 of the main shaft 4, the side surface thereof on the rear side in the rotational direction of the main shaft closely contacting the front side surface 12 of the fixed blocking element 11. The expansion blocking element 16 is provided between the front side surface of the active block 14 and the rear side surface 13 of the fixed blocking element 11 so as to closely contact both of them. The fixed blocking element 11 is provided in the portion thereof which is adjacent to the expansion blocking element 16 with an ignition plug (or an injection valve) 30. The rotational direction of the rotor 4 is the direction of an arrow in FIG. 1.

The operation of this side pressure type rotary engine will now be described with reference to FIGS. 3–5.

Figure 3A:
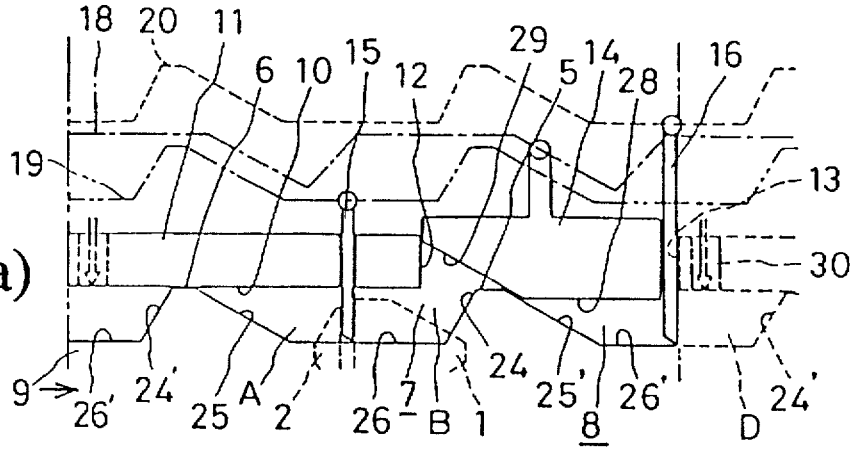
FIG. 3(*a*) is an elevation showing the structure of FIG. 1 in an operating position.
Figure 4A:
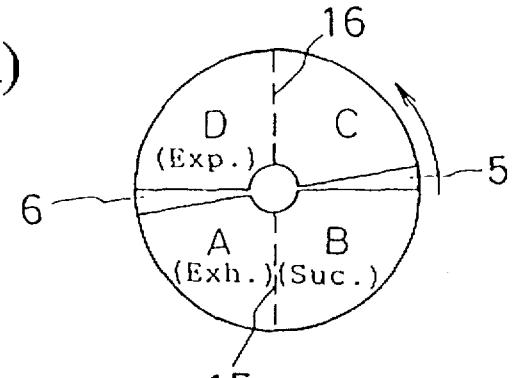
FIG. 4(*a*) is an explanatory view showing the operation of the rotor, viewed form a position above the rotor, of the basic structure shown in FIG. 1.
Figure 4B:
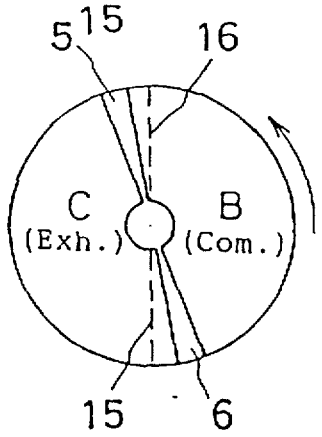
Figure 4C:
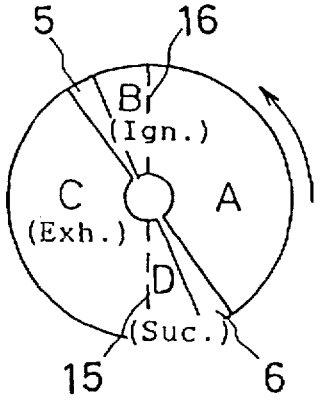

In FIG. 3*a*, the suction and exhaust blocking element 15 moves down and closely contacts the bottom surface 26 of the first working chamber-forming recess 7, whereby the first working chamber-forming recess 7 is divided into two working chamber-forming spaces A and B which are on the rear side and front side with respect to the rotational direction (shown by an arrow) of the rotor 9, while the expansion blocking element 16 moves down to closely contact the bottom surface 26' of the second working chamber-forming recess 8, whereby a working chamber-forming space D is formed in a separated state on the front side of the second working chamber-forming recess 8. At this time, the active block 14 moves up, slidingly contacting the rear wall surface 25' of the second working chamber-forming recess 8 of the rotor 9 at the rear inclined surface 29 thereof. This condition corresponds to that shown in FIG. 4*a*. During this time, an exhaust stroke is carried out in the space A, a suction stroke in the space B, and an expansion stroke in the space D.

Figure 3B:
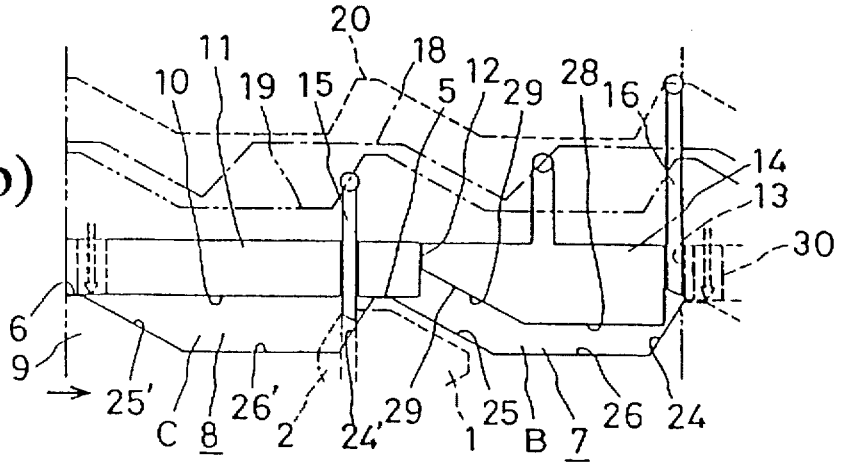

When the rotor 9 is rotated, the suction and exhaust blocking element 15 moves over the flat surface portion 6 on the rear side of the first working chamber-forming recess 7 and enters the second working chamber-forming recess 8 as shown in FIG. 3*b*, whereby a working chamber-forming space C is formed in a separated state on the rear side of the suction and exhaust blocking element 15. Meanwhile, the expansion blocking element 16 moves over the flat surface portion 6 on the rear side of the second working chamber-forming recess 8 and enters the first working chamber-forming recess 7, whereby the working chamber-forming space B is formed on the rear side of the expansion blocking element 16. At this time, the active block 14 moves down to the bottom surface 26 of the first working chamber-forming recess 7 so as to decrease the volume of the working chamber-forming space 8 formed on the rear side of the blocking element 16 in the first working chamber-forming recess 7. This condition corresponds to that shown in FIG. 4*b*. During this time, an exhaust stroke is carried out in the space C, and an compression stroke in the space B.

Figure 3C:
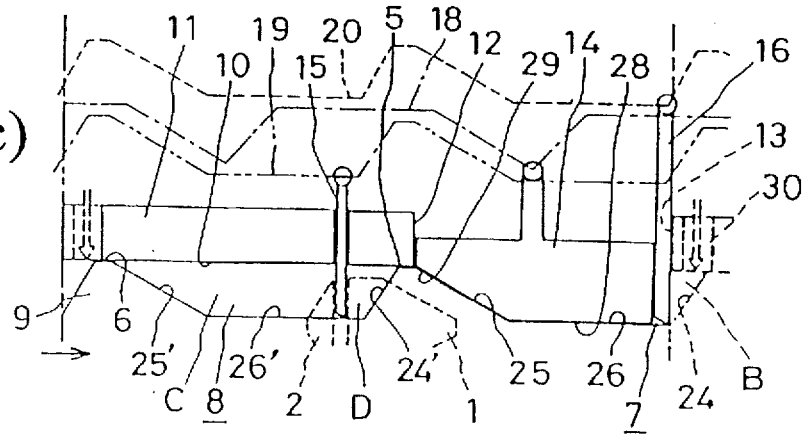

When the rotor 9 is further rotated, the suction and exhaust blocking element 15 moves down to closely contact the bottom surface 26' of the second working chamber-forming recess 8 as shown in FIG. 3*c*, whereby the second working chamber-forming recess 8 is divided into rear and front working chamber-forming space C and D, while the expansion blocking element 16 moves down to closely contact the bottom surface 26 of the first working chamber-forming recess 7, whereby the working chamber-forming space B is formed in a separated state on the front side of the first working chamber-forming recess 7. At this time, the active block 14 closely contacts the bottom surface 26 of the first working chamber-forming recess 7, and then moves up, slidingly contacting the rear wall surface 25 of the first working chamber-forming recess of the rotor 9. This condition corresponds to that shown in FIG. 4*c*. During this time, ignition is carried out in the space B, an exhaust stroke in the space C, and a suction stroke in the space D.

Figure 5:
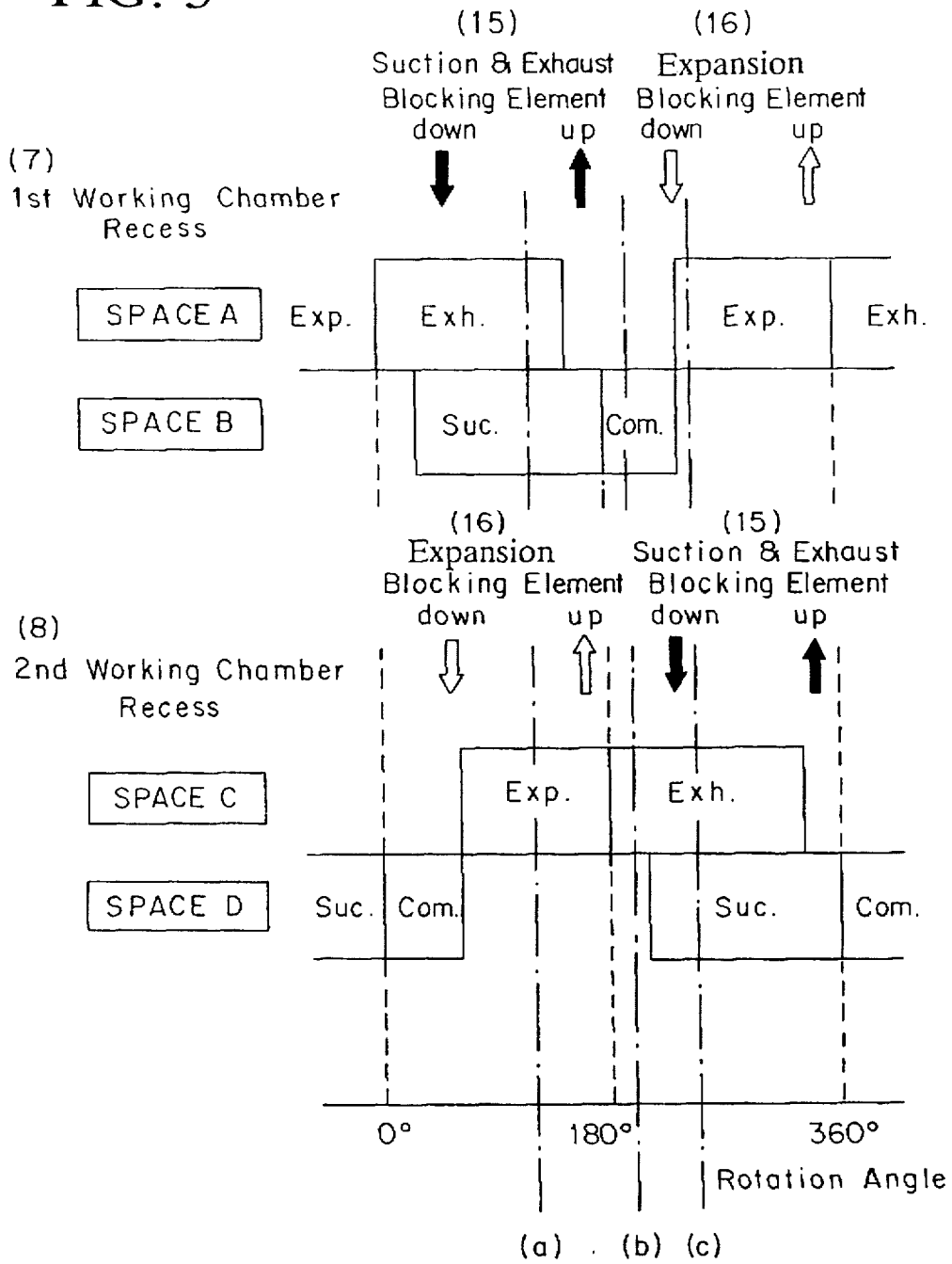
FIG. 5 is a stroke diagram of the engine based on the basic structure shown in FIG. 1.

Because such operations are carried out continuously, exhaust and expansion strokes are carried out in the space A in the first working chamber-forming recess 7, and suction and compression strokes in the space B therein as shown in FIG. 5. Meanwhile, exhaust and expansion strokes are carried out in the space C in the second working chamber recess 8, and suction and compression strokes in the space D therein. Accordingly, the explosive expansion stroke is carried out twice while the rotor 9 makes one turn. FIGS. 3*a*–3*c* and FIGS. 4*a*–4*c* correspond to the timings a–c respectively in FIG. 5.

Figure 6A:
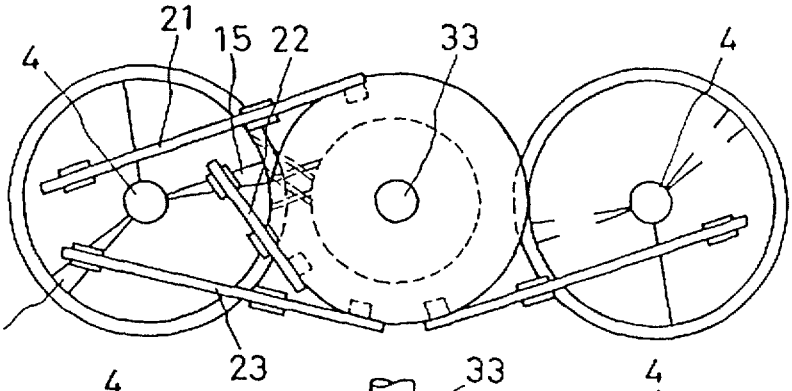
FIG. 6(*a*) is a top view of another example of a side pressure type rotary engine.
Figure 6B:
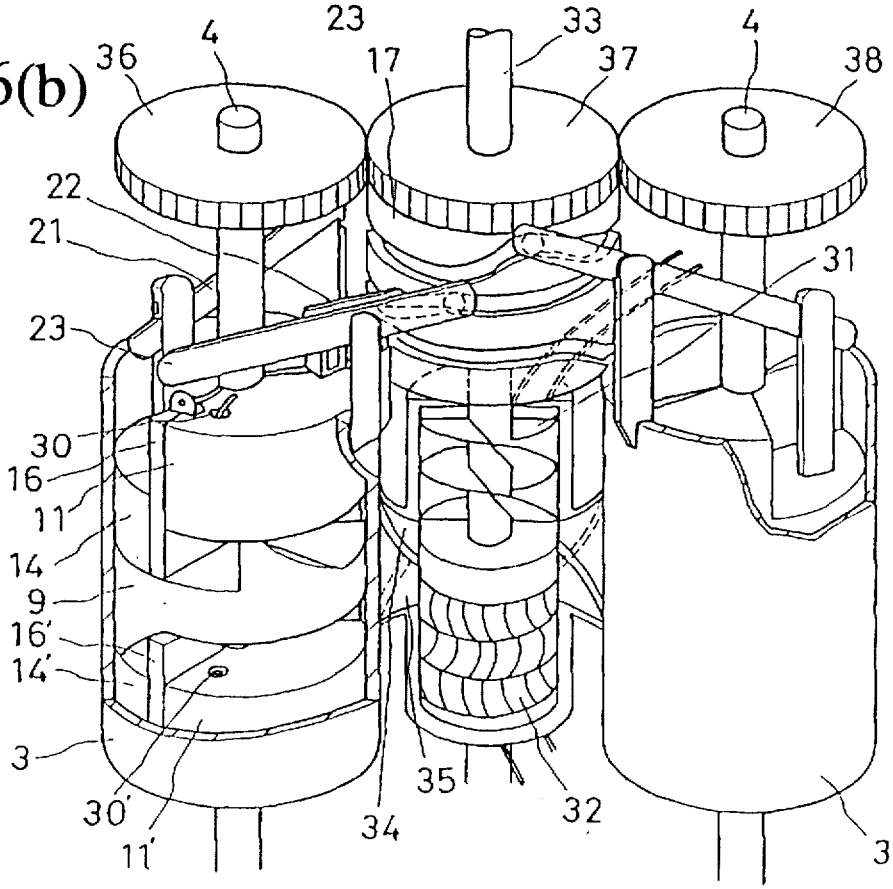
Figure 7A:
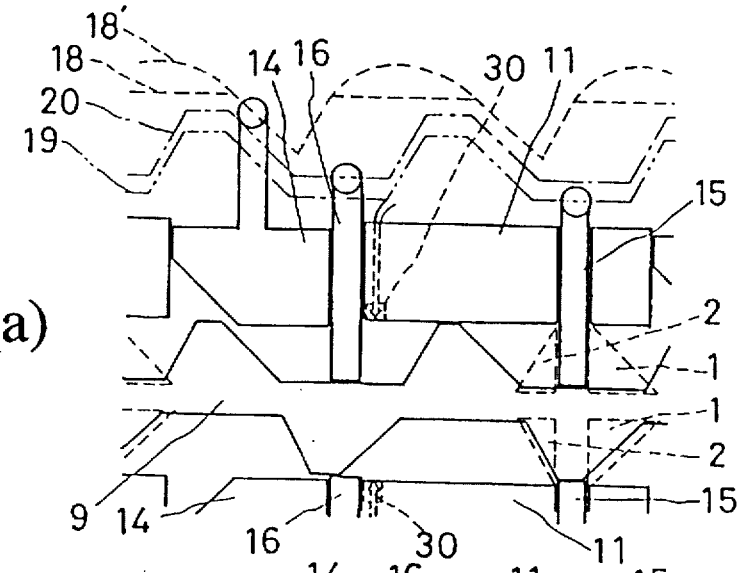
FIG. 7(*a*) is a development elevation showing the operational condition of an embodiment of the present invention.
Figure 7B:
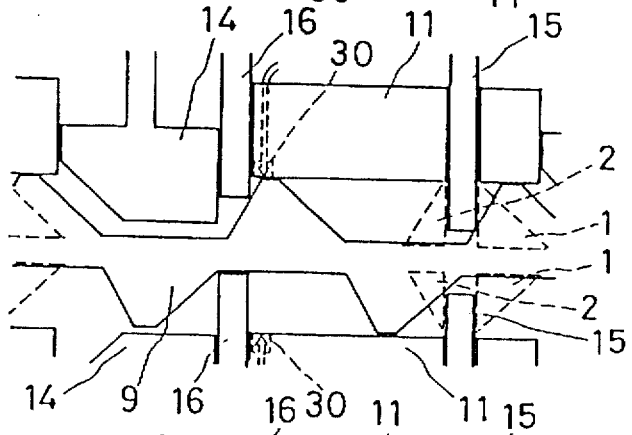
Figure 7C:
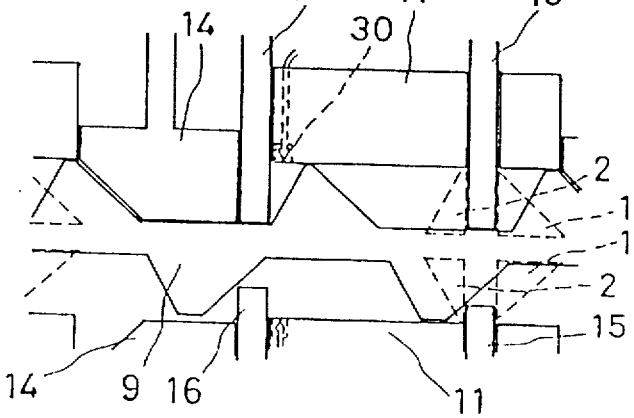

The present invention can be embodied in the following mode. As shown in FIG. 6*a*, a propeller shaft 33 on which both a suction blower 31 and an exhaust turbine 32 are mounted is provided, and a plurality of cylinders 3 on the same circle having the propeller shaft 33 in the center. The suction ports and exhaust ports of the cylinders 3 are set in contact with discharge ports 34 of the suction blower 31 and the pressure supply ports 35 of the exhaust turbine 32 with the cylindrical cam 17 provided on a free end portion of the propeller shaft 33. In the embodiment shown in FIG. 6*b*, the cylinders 3 have the cylindrical cam 17 in common, and vertically opposed working chambers respectively, and the respective main shafts 4 are operatively connected to the propeller shaft 33 via gears 36, 37, 38. The operational principle of each working chamber is basically identical with that described previously with reference to FIGS. 3–5. FIGS. 7a–7c is a development elevation showing the operational condition of the embodiment of FIG. 6, and identical with FIG. 3. The operational condition of an upper working chamber shown in FIGS. 7a–7c corresponds to that shown in FIGS. 3a–3c. The operational principle of a lower working chamber is identical with that of the upper working chamber, though the phase is staggered. According to the embodiment of FIG. 6, an exhaust pressure is utilized to rotate the turbine 32 and drive the blower 31. Therefore, the energy can be utilized effectively, and the engine efficiency increases. Since a plurality of cylinders 3 are provided on the same circle having in the center thereof the propeller shaft 33 provided with the blower 31 and turbine 32 thereon with the suction ports and exhaust ports of the cylinders 3 set in contact with the discharge ports of the suction blower 31 and the pressure supply ports 35 of the exhaust turbine 32, the rocker arms 21, 22, 23 engaged with the cylinders 3 can be driven by the single cylindrical cam 17 provided on the propeller shaft 33. Since the distance between the exhaust port of each cylinder and the relative pressure supply port 35 of the turbine 32 can be set equal and shorter, a loss of the exhaust pressure supplied to the turbine 32 can be reduced.

It is more advantageous to form the present invention in the following manner on the basis of, for example, the above-described structure in order to increase output.

(1) The active block driving cam groove 18 is modified as shown by reference numeral 18' in FIG. 7, in such a manner that the active block 14 is moved at a larger stroke and to a higher position than the suction and exhaust block 15 and expansion block 16 which are moved vertically (in the direction of the axis of the cylinder 3) along the bottom surfaces 26, 26' of the working chamber-forming recesses 7, 8. This makes it possible to increase the height of a top dead center of the active block 14, increase suction volume and heighten the compression ratio.

Figure 8:
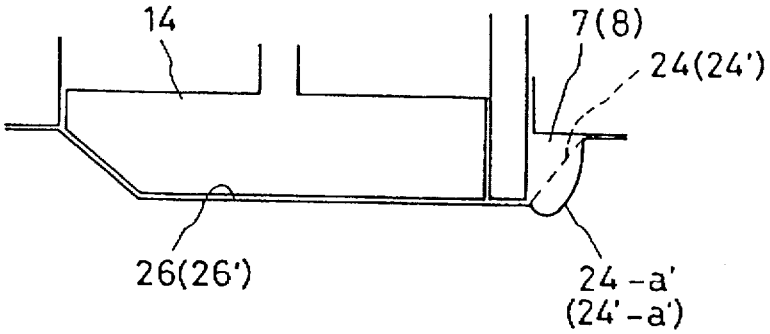
FIG. 8 is an explanatory view of another embodiment.

(2) The wall surface 24 (24'), which is on the front side with respect to the rotational direction of the main shaft, of the working chamber-forming recess 7 (8) is modified so that the portion thereof which is near the bottom surface 26 (26') of the working chamber-forming recess 7 (8) becomes deeper than the bottom surface 26 (26') as shown by a reference numeral 24-a' (24'-a') in FIG. 8, whereby suction volume and rotational force are increased.

Figure 9:
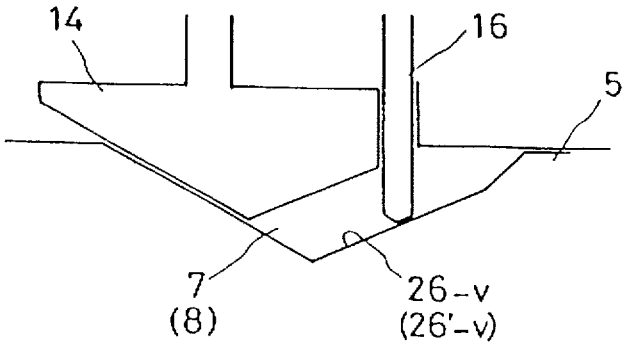
FIG. 9 is an explanatory view of still another embodiment.

(3) The bottom surface 26 (26') of the working chamber-forming recess 7 (8) is recessed in the shape of the letter "V" as shown by a reference numeral 26-v (26'-v') in FIG. 9 so as to increase the pressure receiving area at the time of expansion of a gas, whereby rotational force is increased.

It should be understood that we intend to cover by the appended claims all modifications falling within the true spirit and scope of our invention.

What is claimed is:

1. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recesses into two second working chamber-forming recesses;

a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein wall surfaces of said first working chamber-forming recesses at the front side of said first working chamber-forming recesses are set at the portions thereof which are near the bottom surfaces of said first working chamber-forming recesses and are set at a depth larger than the depth of said bottom surfaces.

2. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recesses into two second working chamber-forming recesses;

a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein said bottom surfaces of said first working chamber-forming recesses are recessed in the shape of the letter "V."

3. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recesses into two second chamber-forming recesses;

a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein said driving mechanism is formed by a cylindrical cam provided on a free end portion of said main shaft, and a plurality of rocker arms engageable with respective cam grooves in said cylindrical cam;

wherein wall surfaces of said first working chamber-forming recesses at the front side of said first working chamber-forming recesses are set at the portions thereof which are near the bottom surfaces of said first working chamber-forming recesses and are set at a depth larger than the depth of said bottom surfaces.

4. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recess a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein said engine is further provided with a propeller shaft having both a suction blower and an exhaust turbine mounted thereon, a plurality of cylinders being provided on the same circle having said propeller shaft in the center thereof, the suction port and exhaust port of each of said cylinders being set in contact with a discharge port of said suction blower and a pressure supply port of said exhaust turbine, said driving mechanism being formed by a cylindrical cam provided on a free end portion of said main shaft, and rocker arms engageable with a plurality of cam grooves in said cylindrical cam;

wherein said active block is moved at a larger stroke than said first and second movable blocking elements with a top dead center of said active block set high.

5. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recesses into two second working chamber-forming recesses;

a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein said driving mechanism is formed by a cylindrical cam provided on a free end portion of said main shaft, and a plurality of rocker arms engageable with respective cam grooves in said cylindrical cam;

and said bottom surfaces of said working chamber-forming recess are recessed in the shape of the letter "V".

6. A side pressure type rotary engine comprising a cylinder having a suction port and an exhaust port formed in predetermined portions thereof, said suction port and said exhaust port being circumferentially spaced from each other;

a main shaft passes through said cylinder along the axis of said cylinder;

a rotor having a columnar body, the outer circumferential surface of which extends along an inner circumferential surface of said cylinder;

said rotor provided with a pair of flat end surface portions diametrically opposed to each other on both sides of the axis of said rotor and mounted fixedly on the main shaft and rotated unitarily therewith, said flat end surface portions provided with a first and second or a pair of working chamber-forming recesses on both sides of said flat end surface portions;

a fixed blocking element adapted to close a predetermined range of a head portion of said cylinder with a bottom surface of said blocking element, said bottom surface of said blocking element being slidingly in contact with said flat end surface portions of the rotor;

an active block movable along side surfaces of said fixed blocking element and in parallel with the axis of said cylinders;

a first movable blocking element located between said suction port and said exhaust port and adapted to close the part of said head portion of said cylinder and move in parallel with the axis of said cylinder so as to divide one of said first working chamber-forming recesses in said end surface of said rotor into two first working chamber-forming spaces;

a second movable blocking element which is substantially opposed to said first movable blocking element with respect to the axis of said cylinder, said second movable blocking element adapted to close part of said head portion of said cylinder and move in parallel with the axis of said cylinder so as to divide said second chamber-forming recesses into two second working chamber-forming recesses;

a suction and exhaust blocking element located between the suction port and the exhaust port, said suction and exhaust blocking element adapted to close the part of the head portion of the cylinder and move in parallel with the axis of the cylinder so as to divide the working chamber-forming recesses into two first working chamber-forming spaces;

an expansion blocking element which is substantially opposed to the suction and exhaust blocking element with respect to the axis of the cylinder, said expansion blocking element adapted to close the part of the head portion of the cylinder and move in parallel with the axis of the cylinder so as to divide the working chamber-forming recess into two second working chamber-forming spaces;

a driving mechanism adapted to move said active block and said first and second movable blocking elements at predetermined timings and strokes, whereby the expansive force of a gas is exerted on said rotor in the tangential direction thereof to rotate said rotor in the tangential direction thereof to rotate said main shaft;

wherein said engine is further provided with a propeller shaft having both a suction blower and an exhaust turbine mounted thereon, a plurality of cylinders being provided on the same circle having said propeller shaft in the center thereof, the suction port and exhaust port of each of said cylinders being set in contact with a discharge port of said suction blower and a pressure supply port of said exhaust turbine, said driving mechanism being formed by a cylindrical cam provided on a free end portion of said main shaft, and rocker arms engageable with a plurality of cam grooves in said cylindrical cam;

wherein said bottom surfaces of said working chamber-forming recess are recessed in the shape of the letter "V".

* * * * *